US006392358B1

(12) United States Patent
Runau et al.

(10) Patent No.: US 6,392,358 B1
(45) Date of Patent: May 21, 2002

(54) LIQUID CRYSTAL DISPLAY BACKLIGHTING CIRCUIT

(75) Inventors: Albert L. Runau, Marion; Ryan J. Rand, Mt. Vernon, both of IA (US)

(73) Assignee: Rockwell Collins, Inc., Cedar Rapids, IA (US)

( * ) Notice: Subject to any disclaimer, the term of this patent is extended or adjusted under 35 U.S.C. 154(b) by 0 days.

(21) Appl. No.: 09/847,726

(22) Filed: May 2, 2001

(51) Int. Cl.[7] ..... H05B 37/02

(52) U.S. Cl. ..... 315/185 R; 315/193; 315/169.3; 315/186

(58) Field of Search ..... 315/185 R, 185 S, 315/193, 186, 312, 169.3

(56) References Cited

U.S. PATENT DOCUMENTS 6,285,140 B1 * 9/2001 Ruxton ..... 315/312

* cited by examiner

*Primary Examiner*—David Vu
(74) *Attorney, Agent, or Firm*—Nathan O. Jensen; Kyle Eppele

(57) ABSTRACT

The present invention is a system and method for directing the flow of current supplied for a collection of light emitting diodes to provide for rapid flashing of the light emitting diodes and a wide dimming range. A fixed amount of current may be available to the collection of light emitting diodes where the flow of the current may be controlled by an alternating periodic signal such that current passes through the light emitting diodes for predefined and discrete periods. During periods of time that current is not flowing through light emitting diodes, the current may be directed to flow in another area of the circuit. The duty cycle of the signal may be adjusted in order to vary the dimming capability of the backlight.

20 Claims, 4 Drawing Sheets

LIQUID CRYSTAL DISPLAY BACKLIGHTING CIRCUIT

FIELD OF THE INVENTION

The present invention relates generally to constant lighting systems and more specifically to a system and method for providing backlight for a liquid crystal display.

BACKGROUND OF THE INVENTION

In the manufacture and use of liquid crystal displays, backlighting from a light source is dispersed evenly beneath the surface of a liquid crystal display to allow optimal viewing of the display in all types of ambient light conditions. Depending upon the light conditions of the environment, the light intensity of the backlight may be adjusted to allow optimal viewing of the liquid crystal display. Liquid crystal display backlights frequently employ fluorescent lamps. However, fluorescent lamps require high power and a high voltage source. Another method of providing backlight is through the utilization of light emitting diodes. Light emitting diodes are utilized for backlights in liquid crystal displays due to their dimming range, low-temperature performance, and efficient heatsinking attributes.

A collection of light emitting diodes may be connected serially or in parallel to form a backlight for a liquid crystal display. It is known to the art to flash light emitting diodes of a backlight on and off in a rapid fashion such that it appears to provide a constant light source. Flashing of the light emitting diodes has been accomplished by the switching of the current producing source, either a voltage source or a current source. However, switching of the current producing source can not be accomplished quickly, thus affecting the ability to adjust the light intensity level of the backlight. Slow switching of the current producing source does not allow a wide range of dimming of the backlight. Further, switching of the current producing source increases electromagnetic interference and noise within the backlighting circuit. Consequently, it would be advantageous if a system and method existed which allowed a wide dimming range and allowed for rapid flashing of light emitting diodes. It would also be advantageous if a system and method existed for flashing of light emitting diodes which could reduce the amount of electromagnetic interference and noise within the circuit.

SUMMARY OF THE INVENTION

Accordingly, the present invention is directed to a system and method of directing the flow of current supplied for a collection of light emitting diodes on an alternating cycle which allows for rapid flashing of light emitting diodes and provides a wide dimming range. A fixed amount of current may be available to the collection of light emitting diodes where the flow of the current may be controlled by an alternating periodic signal such that current passes through the light emitting diodes for predefined and discrete periods. During periods of time that current is not flowing through light emitting diodes, the current may be directed to flow in another area of the circuit. The duty cycle of the alternating periodic signal may be adjusted in order to vary the dimming capability of the LED backlights. Since the light emitting diodes may be controlled by directing the flow of current rather than by switching of the current producing source, less electromagnetic interference and noise may be present within the system.

It is to be understood that both the foregoing general description and the following detailed description are exemplary and explanatory only and are not restrictive of the invention claimed. The accompanying drawings, which are incorporated in and constitute a part of the specification, illustrate an embodiment of the invention and together with the general description, serve to explain the principles of the invention.

BRIEF DESCRIPTION OF THE DRAWINGS

The numerous objects and advantages of the present invention may be better understood by those skilled in the art by reference to the accompanying figures in which.

DETAILED DESCRIPTION OF THE INVENTION

Reference will now be made in detail to a presently preferred embodiment of the invention, an example of which is illustrated in the accompanying drawings.

Figure 1:
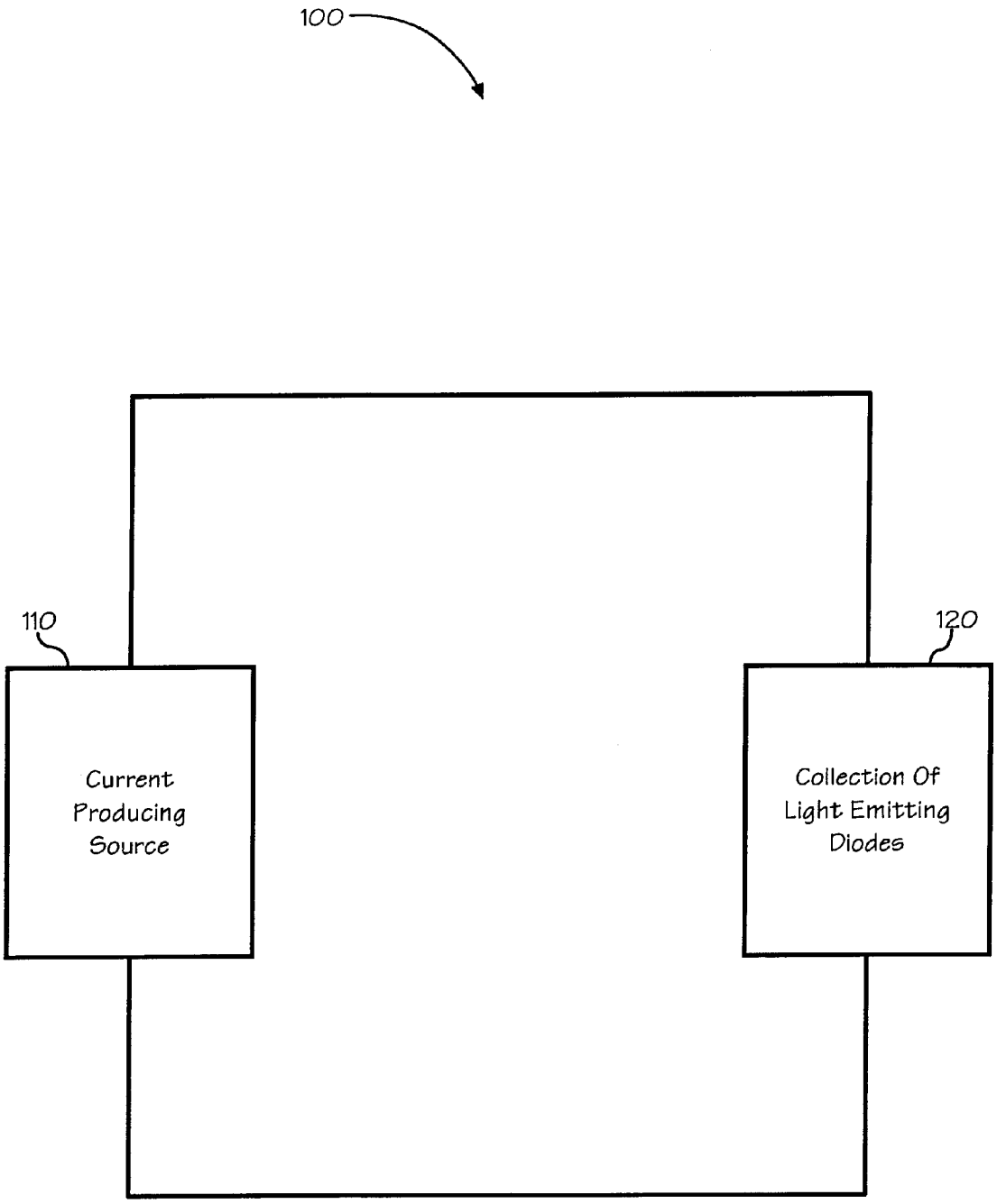
FIG. 1 Prior Art
FIG. 1 depicts an embodiment of a system for supplying current to a collection of light emitting diodes known to the art.

Referring to FIG. 1, a system 100 for supplying current to a collection of light emitting diodes known to the art is shown. When the current producing source 110 is on, the collection of light emitting diodes 120 receives current and emits light. It should be known by one of ordinary skill in the art that current producing source 10 may be implemented in various ways which may include use of a voltage supply and current supply. In order to turn the collection of light emitting diodes 120 on and off in a rapid fashion, referred to as flashing of the light emitting diodes, current producing source 110 must be turned on and off in a rapid fashion. However, rapid flashing of the collection of light emitting diodes 120 is limited by the amount of time required to switch the current producing source 110 on and off. A threshold amount of time is required to switch the current producing source 110 from on to off and from off to on, as a result, flashing of the collection of light emitting diodes 120 is relatively slow.

Another disadvantageous result of the system 100 for supplying current to a collection of light emitting diodes known to the art is the additional electromagnetic interference and noise created within the system. Switching of the current producing source 110 in order to produce flashing of the collection of light emitting diodes 120 results in a creation of noise and interference into the system. If a current producing source may be maintained in the on position while generating a flashing condition of the collection of light emitting diodes, the system may be more stable.

Figure 2:
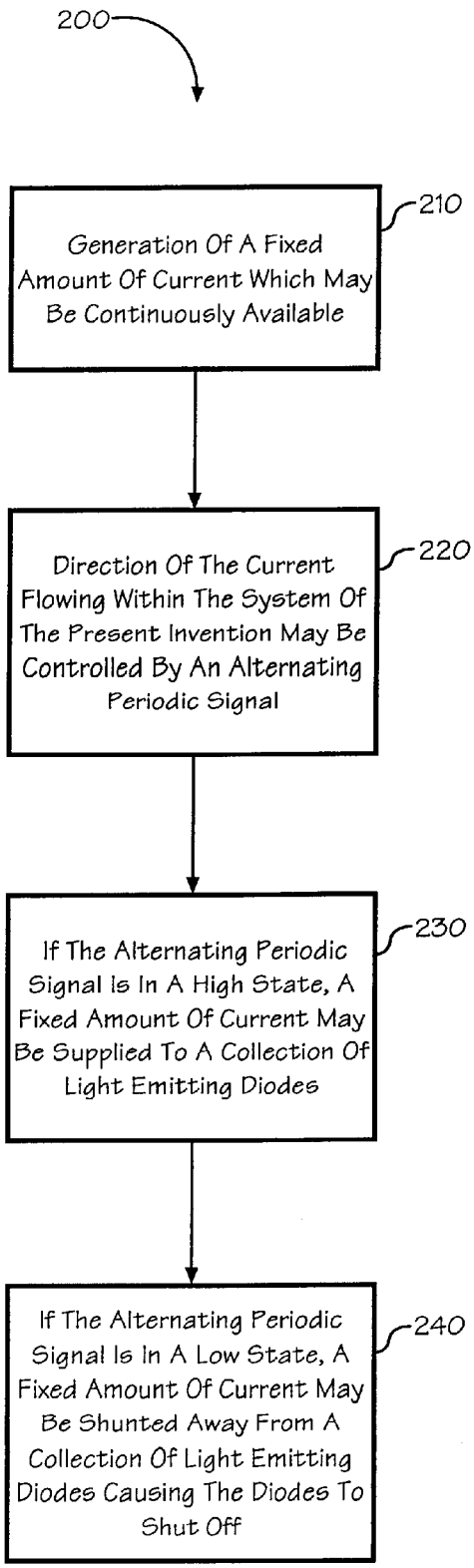
FIG. 2 depicts an embodiment of a process to supply current to a collection of light emitting diodes of the present invention.

Referring now to FIG. 2, an embodiment of a process 200 to supply current to a collection of light emitting diodes of the present invention is shown. The process may begin by generation of a fixed amount of current. The fixed amount of current may be continuously available 210. Thus, rather than switching the current producing source on and off creating noise and interference within the system, the current may be continually supplied. The flow of current within the system of the present invention may be controlled by an alternating periodic signal applied to the system 220.

In an exemplary embodiment of the present invention, the alternating periodic signal applied to the system may be in the form of a pulse width modulated signal. Pulse width modulation refers to a method of carrying information on a train of pulses, the information being encoded in the width of the pulses. Pulse width modulation may provide an output logic one for a period of time and an output logic zero for the balance of time. A duty cycle of a pulse width modulation signal refers to the ratio of high time (logic one) to low time (logic zero). A pulse width modulated signal may be connected to a device, a transistor for example, which may turn on and off depending upon whether the signal is in a high state or a low state whereby flow of current within the system may be directed accordingly. While a pulse width modulated signal may be utilized in the application of the present invention, a person of ordinary skill in the art may apply other types of alternating periodic signals to the system without departing from the scope and spirit of the present invention.

When an alternating periodic signal is applied to the system of the present invention, the signal may include a first state and a second state. First and second states may be a low state and a high state or a high state and low state respectively. A low state and a high state may refer to a low amplitude and a high amplitude respectively. If the alternating periodic signal is in a high state, a device connected to the modulated signal may be off. Current flowing within the system may pass through the collection of light emitting diodes and may cause the diodes to emit light for as long as the signal is in a high state 230. Upon a change of the alternating periodic signal from a high state to a low state, current may be shunted away from a collection of light emitting diodes causing the diodes to shut off 240.

Figure 3:
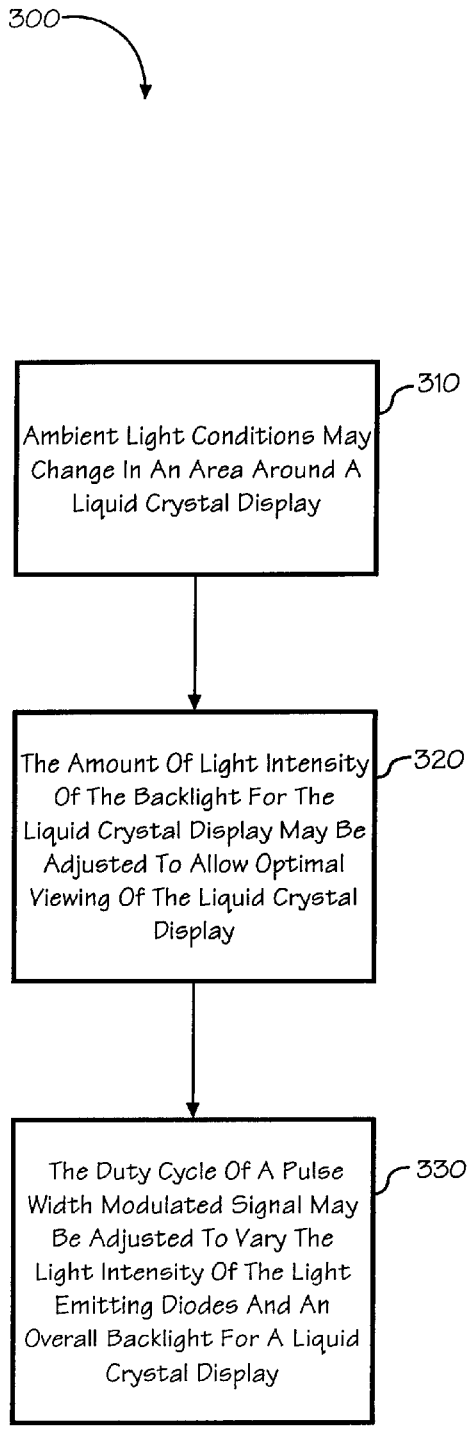
FIG. 3 depicts an embodiment of a process for adjusting the light intensity of a backlight for a liquid crystal display of the present invention.

Referring to FIG. 3, an embodiment of a process 300 for adjusting the light intensity of a backlight for a liquid crystal display is shown. As a user views images and data presented upon a liquid crystal display, the ambient light conditions may change in an area around a liquid crystal display 310. The amount of light intensity of the backlight for a liquid crystal display may be adjusted to allow optimal viewing of the liquid crystal display 320. For example, a user may require a higher light intensity of the backlight in well-lit conditions and may require a lesser light intensity of the backlight in low-light conditions when viewing a liquid crystal display.

The light intensity of a light emitting diode and a collection of light emitting diodes may be adjusted by varying a length of time each light emitting diode is on. If a light emitting diode is on for a short time, the light emitted from the light emitting diode may be a lower intensity. However, the light emitted from a light emitting diode which is on for a longer duration of time may produce a greater intensity of light. The duty cycle of an alternating periodic signal, a pulse width modulated signal for example, may be utilized to control the on and off times of a collection of light emitting diodes as described in FIG. 2. The duty cycle of a pulse width modulated signal may be adjusted to vary the length of time a light emitting diode is on. Thus, the duty cycle of the pulse width modulated signal may be adjusted to vary the light intensity of the light emitting diodes and the light intensity of an overall backlight for a liquid crystal display.

Figure 4:
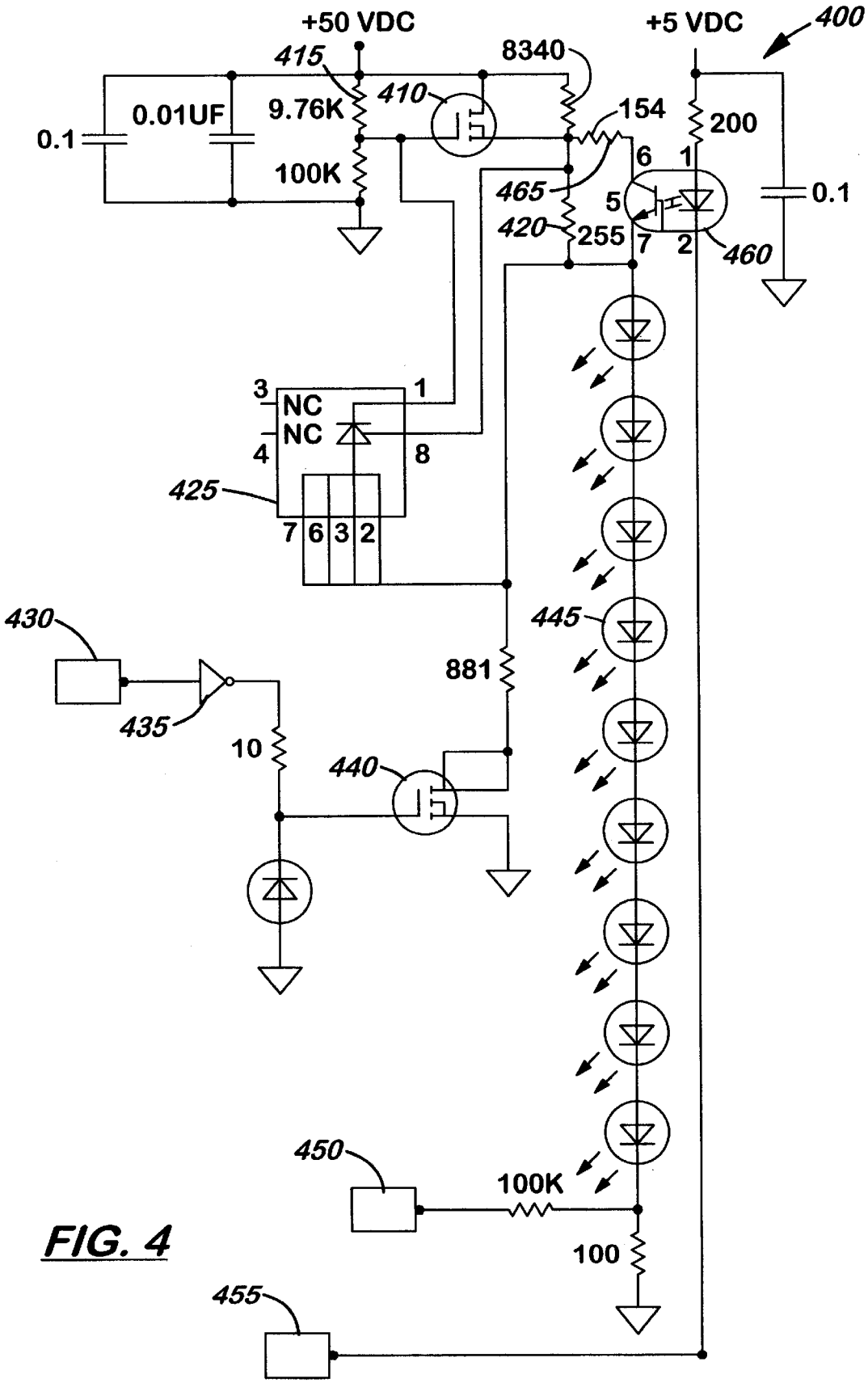
FIG. 4 depicts an embodiment of a circuit for directing current within the circuit to allow rapid flashing of light emitting diodes in accordance with the present invention.

Referring now to FIG. 4, an embodiment of a circuit 400 for directing current within the circuit to allow rapid flashing of light emitting diodes in accordance with the present invention is shown. The circuit may supply a constant current to a string of light emitting diodes without the requirement of switching a voltage supply and current supply on and off. A transistor 410, a N-channel field effect transitor for example, may be normally on. A resistor 415 of approximately 9.76 kiloOhms may be connected between the gate and drain of transistor 410. Current may flow in transistor 410 toward a resistor 420 of approximately 255 Ohms. Resistor 420 may be shunted by pins 6 and 8 of a voltage reference device 425. Voltage reference device 425 may shut off when the voltage between pins 6 and 8 reaches 2.5 volts which may short across gate and source (pins 1 and 3) and may turn transistor 410 off. The voltage across resistor 420 may be clamped to 2.5 volts and the current through resistor 420 may be approximately 10 milliAmperes. Thus 10 milliAmperes may be available to each of the light emitting diodes 445 in the string and may constitute a full brightness condition.

A pulse width modulated signal 430 may be applied to the circuit. The signal may be inverted at inverter 435 and applied to transistor 440, a N-channel field effect transistor for example. In the embodiment as shown in FIG. 4, after the signal 430 has been inverted, it is connected to the gate of the field effect transistor 440. When the pulse width modulated signal 430 is in a low state originally and is inverted to a high state, transistor 440 may be on and current is shunted through transistor 440 which may cause the light emitting diodes to shut off. When the pulse width modulated signal 430 is in a high state originally and is inverted to a low state, transistor 440 may be off and current may be supplied to the light emitting diodes. An advantageous aspect of the circuit 400 of the present invention is the ability to provide rapid flashing of the light emitting diodes. Further, the light emitting diodes may be capable of providing light levels of less than approximately 0.1 foot-lambert to greater than 200 foot-lambert. This wide range of dimming capability may not be possible when flashing of light emitting diodes is accomplished by switching of a current producing source. Adjustment of the dimming capability may be achieved by adjusting the duty cycle of pulse width modulated signal 430.

Circuit 400 of the present invention may also be capable of extending the life of the life emitting diodes and allow for a longer duration of time between maintenance cycles. Signal 450 may be utilized to certify that the light emitting diodes 445 are receiving current and, that there is not a light emitting diode 445 which has failed open. Testing for a short is not as critical as a short in a light emitting diode 445 may not damage operation but may reduce the light intensity output and may increase power dissipation in transistor 410.

A signal 455 may be applied to increase a fixed current level from approximately 10 milliAmperes to approximately 20 milliAmperes. This may be advantageous as it may provide a wider range of dimming and may provide for a greater light intensity as the light emitting diodes age. As light emitting diodes age, the amount of light output versus current may be reduced, thus the ability to provide a larger amount of current may extend the life of the light emitting diodes and may provide a longer maintenance cycle when implemented into a liquid crystal display.

The increase in the fixed current level may be achieved by causing a diode to conduct and turn on an accompanying transistor 460. This may shunt resistor 465 across resistor 420 which may reduce the total resistance. The reduction of total resistance coupled with the fixed voltage of 2.5 volts may result in a current output from transistor 410 of approximately 20 milliAmperes.

The embodiment of circuit 400 is merely an example of an implementation of the present invention. It should be understood that a person of ordinary skill in the art may interchange the components and connections as shown in FIG. 4 to achieve a similar result without departing from the scope and spirit of the present invention.

It is believed that the present invention and many of its attendant advantages will be understood by the foregoing description, and it will be apparent that various changes may be made in the form, construction, and arrangement of the components thereof without departing from the scope and spirit of the invention or without sacrificing all of its material advantages. The form herein before described being merely an explanatory embodiment thereof, it is the intention of the following claims to encompass and include such changes.

What is claimed is:

1. A method of directing flow of current within a circuit, comprising:

providing a fixed amount of current to a circuit;

applying an alternating periodic signal to a device in said circuit; said alternating periodic signal including a first state and a second state;

directing flow of said fixed amount of current, wherein said fixed amount of current is supplied to a collection of light emitting diodes when said alternating periodic signal is in said first state, said fixed amount of current being diverted from said collection of light emitting diodes such that said collection of light emitting diodes are off when said alternating periodic signal is in said second state, said collection of light emitting diodes being capable of flashing at a rate determined by said alternating periodic signal by supplying and diverting current to said collection of light emitting diodes.

2. The method as claimed in claim 1, wherein said fixed amount of current is provided by utilizing a voltage supply, at least one resistor, and a transistor.

3. The method as claimed in claim 1, wherein said device in said circuit is a transistor, said transistor being off when said alternating periodic signal is in said first state, said transistor being on when said alternating periodic signal is in said second state.

4. The method as claimed in claim 1, wherein said alternating periodic signal is a pulse width modulated signal.

5. The method as claimed in claim 4, wherein said rate of flashing of said collection of light emitting diodes is capable of being adjusted by varying a duty cycle of said pulse width modulated signal.

6. The method as claimed in claim 5, wherein said collection of light emitting diodes is capable of providing a light intensity level in the range of approximately 0.1 to 200 foot-lambert.

7. The method as claimed in claim 6, further comprising verifying said circuit to determine if said fixed amount of current is flowing through said collection of light emitting diodes.

8. A backlighting circuit for a liquid crystal display, comprising:

means for providing a fixed amount of current to a circuit capable of being delivered to a collection of light emitting diodes;

an alternating periodic signal connected to said circuit, said alternating periodic signal including a first state and a second state; and means for directing flow of said fixed amount of current, wherein said fixed amount of current is supplied to said collection of light emitting diodes when said alternating periodic signal is in said-first state, said fixed amount of current being diverted from said collection of light emitting diodes when said alternating periodic signal is in said second state, said collection of light emitting diodes being capable of flashing at a rate determined by said alternating periodic signal by supplying and diverting current to and from said collection of light emitting diodes.

9. The backlighting circuit as claimed in claim 8, wherein said alternating periodic signal is a pulse width modulated signal.

10. The backlighting circuit as claimed in claim 9, wherein said rate of flashing of said collection of light emitting diodes is capable of being adjusted by varying a duty cycle of said pulse width modulated signal.

11. The backlighting circuit as claimed in claim 10, wherein said collection of light emitting diodes is capable of providing a light intensity level in the range of approximately 0.1 to 200 foot-lambert.

12. The backlighting circuit as claimed in claim 8, further comprising means for verifying said circuit to determine if said fixed amount of current is flowing through said collection of light emitting diodes.

13. A circuit, comprising:

means for providing a fixed amount of current;

a transistor connected to said providing means, an alternating periodic signal connected to said transistor, said alternating periodic signal including a first state and a second state;

a collection of light emitting diodes connected to said transistor; wherein said fixed amount of current is supplied to said collection of light emitting diodes when said alternating periodic signal is in said first state, said fixed amount of current being diverted from said collection of light emitting diodes such that said collection of light emitting diodes are off when said alternating periodic signal is in said second state; said collection of light emitting diodes being capable of flashing at a rate determined by said alternating periodic signal by supplying and diverting current to and from said collection of light emitting diodes.

14. The circuit as claimed in claim 13, wherein said providing means includes a voltage supply, at least one resistor, and a transistor.

15. The circuit as claimed in claim 13, wherein said transistor is a N-channel field effect transistor.

16. The circuit as claimed in claim 13, wherein said transistor is off when said alternating periodic signal is in said first state, said transistor being on when said alternating periodic signal is in said second state.

17. The circuit as claimed in claim 13, wherein said alternating periodic signal is a pulse width modulated signal.

18. The circuit as claimed in claim 17, wherein said rate of flashing of said collection of light emitting diodes is capable of being adjusted by varying a duty cycle of said pulse width modulated signal.

19. The circuit as claimed in claim 18, wherein said collection of light emitting diodes is capable of providing a light intensity level in the range of approximately 0.1 to 200 foot-lambert.

20. The circuit as claimed in claim 13, further comprising means for verifying said circuit to determine if said fixed amount of current is flowing through said collection of light emitting diodes.

* * * * *